United States Patent [19]

Tilston, deceased et al.

[11] Patent Number: 5,053,785

[45] Date of Patent: Oct. 1, 1991

[54] POLARIZATION SELECTIVE SURFACE FOR CIRCULAR POLARIZATION

[75] Inventors: William V. Tilston, deceased, late of Kemptville, Canada, by Stephen E. Tilston, Mark Tilston, David Tilston, co-executors; Stephen E. Tilston, Kemptville; Mark Tilston, Kemptville; David Tilston, Kemptville; Thomas Tralman, Kemptville, all of Canada

[73] Assignee: Her Majesty the Queen as represented by the Minister of Nat. Defence of Her Majesty's Canadian Government, Ottawa, Canada

[21] Appl. No.: 342,888

[22] Filed: Apr. 25, 1989

[30] Foreign Application Priority Data

Sep. 9, 1987 [CA] Canada ..... 546499

[51] Int. Cl.[5] ..... H01Q 15/24

[52] U.S. Cl. ..... 343/756; 343/797

[58] Field of Search ..... 343/753, 756, 909, 797, 343/798

[56] References Cited

U.S. PATENT DOCUMENTS 2,272,312 2/1942 Tunick ..... 343/814

4,198,641 4/1980 Gibson ..... 343/797

FOREIGN PATENT DOCUMENTS 146563 11/1979 Japan ..... 343/797

OTHER PUBLICATIONS

Schiner, UHF Directional Array with Variable Polarization, News from Rohded Schwarz, 46, vol. 11, 1971.

*Primary Examiner*—Michael C. Wimer

*Attorney, Agent, or Firm*—Stevens, Davis, Miller & Mosher

[57] ABSTRACT

A surface for an antenna for use in discriminating between horizontal and vertical polarization components of a circularly polorized electromagnetic wave comprises at least one pair of dipoles, one of the dipoles of each pair of dipoles being adapted to receive one component of circular polarization and the other dipole of each pair of dipoles being adapted to receive the other component of circular polarization, and a transmission line extending between and electrically connecting the feed points of the dipoles of each pair of dipoles, whereby an incident circularly polarized electromagnetic wave is reflected when its two polarization components are incident upon their respective dipoles in phase and is transmitted when the its two components are incident upon their respective dipoles 180 electrical degrees out-of-phase.

6 Claims, 5 Drawing Sheets

POLARIZATION SELECTIVE SURFACE FOR CIRCULAR POLARIZATION

The present invention relates to a surface for use in discriminating between left hand and right hand circular polarization.

BACKGROUND OF THE INVENTION

The advantages of using polarization selective surfaces for linear polarization have been known for quite some time and have been used in squirrel cage antennae, polarization twist antennae and cassegrainian antennae. For example, polarization selective surfaces have been successfully used to eliminate aperture blockage in cassegrainian antenna systems in which a subreflector is formed of parallel, closely spaced (with respect to wavelength) wire. Such a surface is completely reflective for polarization parallel to the grid and nearly transparent for perpendicular radiation.

Thus, incident radiation which is polarized parallel to the grid is completely reflected onto the main dish of the antenna. The main dish is arranged to rotate the incident polarization by 90°. The rotated and reflected radiation, being perpendicular to the subreflector, will pass through unhindered, thus eliminating aperture blockage. Heretofore, the use of polarization selective surfaces have been confined to linear polarization and has not been extended to circular polarization because of the lack of a surface which is sensitive to the vertical and horizontal components of circular polarization.

SUMMARY OF THE INVENTION

The present invention seeks to provide a surface for electromagnetic waves which is capable of discriminating between left hand and right hand circular polarization.

In accordance with the present invention, there is provided a surface for an antenna for use in discriminating between horizontal and vertical polarization components of a circularly polarized electromagnetic wave, comprising at least one pair of dipoles each having a feed point, one of the dipoles of each pair of dipoles being adapted to receive one component of circular polarization and the other dipole of each pair of dipoles being adapted to receive the other component of circular polarization, and a transmission line extending between and electrically connecting the feed points of each pair of dipoles. The surface will reflect an incident circularly polarized electromagnetic wave if its two components are incident upon their respective dipoles in phase and will be transparent to the wave if its two components are incident upon their respective dipoles 180 electrical degrees out-of-phase.

BRIEF DESCRIPTION OF THE DRAWINGS

These and other features of the invention will become apparent from the following description in which reference is made to the appended drawings, wherein.

DESCRIPTION OF PREFERRED EMBODIMENT

Figure 1:
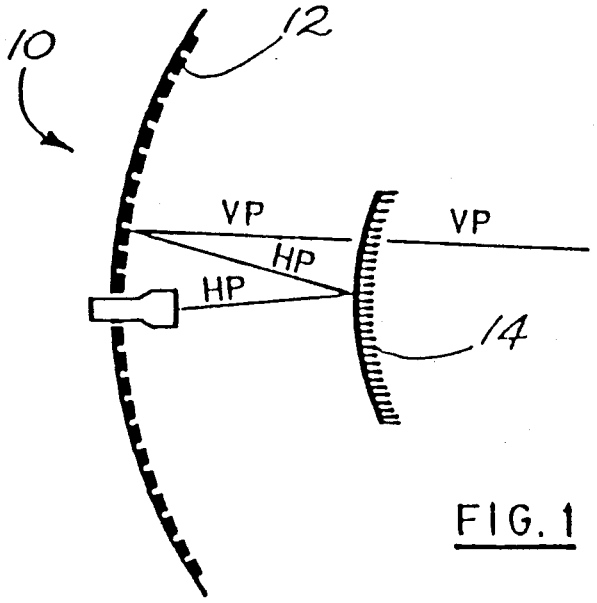
FIG. 1 PRIOR ART
FIG. 1 is a diagrammatic view of a cassegrainian antenna system employing a polarization selective subreflector.

FIG. 1 illustrates a prior art cassegrainian antenna system 10 having a main dish 12 and a subreflector 14. The subreflector is formed of parallel, closed spaced (with respect to wavelength) wires. As is well known, such a surface is completely reflective for polarization parallel to the grid and nearly transparent for perpendicular radiation. Thus, incident radiation which is polarized parallel to the grid is completely reflected onto the main dish. The main dish is arranged to rotate the incident polarization by 90°. The rotated and reflected radiation, being perpendicular to the subreflector, will pass through unhindered and in this manner aperture blockage can be reduced or eliminated.

Heretofore, the use of polarization selective surfaces has been confined to linear polarization and has not been extended to circular polarization because of the lack of a surface which is sensitive to the vertical and horizontal components of circular polarization.

The present invention is based on the transmission line concept that when two electromagnetic waves of equal amplitude and phase enter opposite ends of a length of transmission line, an open circuit will appear across the mid-point of the transmission line and that when two electromagnetic waves of equal amplitude and opposite phase enter opposite ends of a length of transmission line, a short circuit will appear across the mid-point of the transmission line. Thus, as explained more fully hereinbelow, a dipole pair in the form of two dipoles disposed at right angles to one another and connected together at their feed points by a transmission line of suitable length can reflect one polarization of a circularly polarized wave and pass another circularly polarized wave of opposite polarization and thus can serve as a polarization selective antenna.

Figure 2:
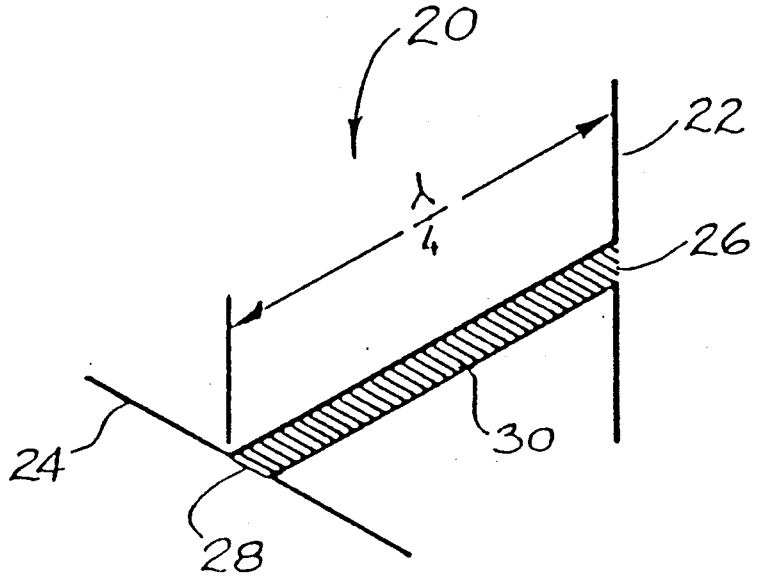
FIGS. 2–4 are diagrammatic views of an antenna according to a preferred embodiment.

With reference to FIG. 2 there is illustrated an antenna unit 20 comprising two resonant, half wave dipoles, including a vertical dipole 22 for receiving the vertical polarization component of a circularly polarized electromagnetic wave and a horizontal dipole 24 for receiving the horizontal polarization component of a circularly polarized electromagnetic wave. The two dipoles are separated by 90 electrical degrees in time. The feed points 26 and 28 of dipoles 22 and 24, respectively, are joined together by a transmission line 30 of electrical length of 180 degrees or multiples thereof or, stated differently, of one half of the wavelength of the incident electromagnetic wave of interest.

Figure 3:
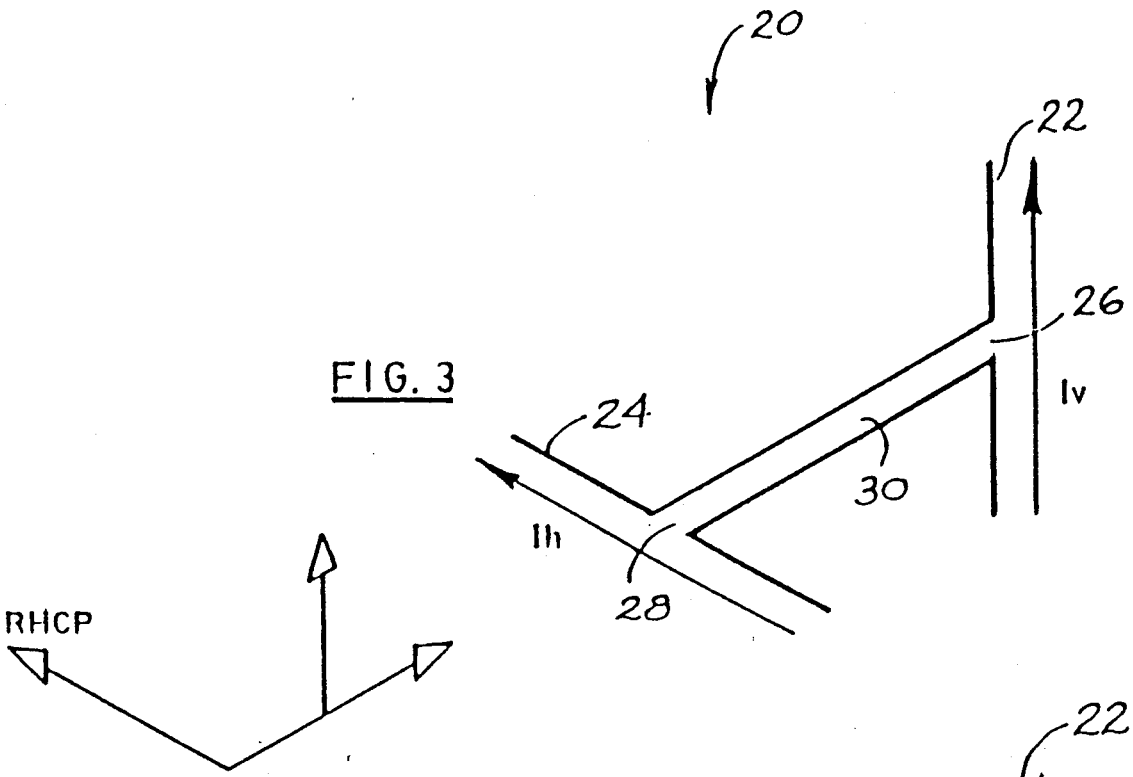
Figure 4:
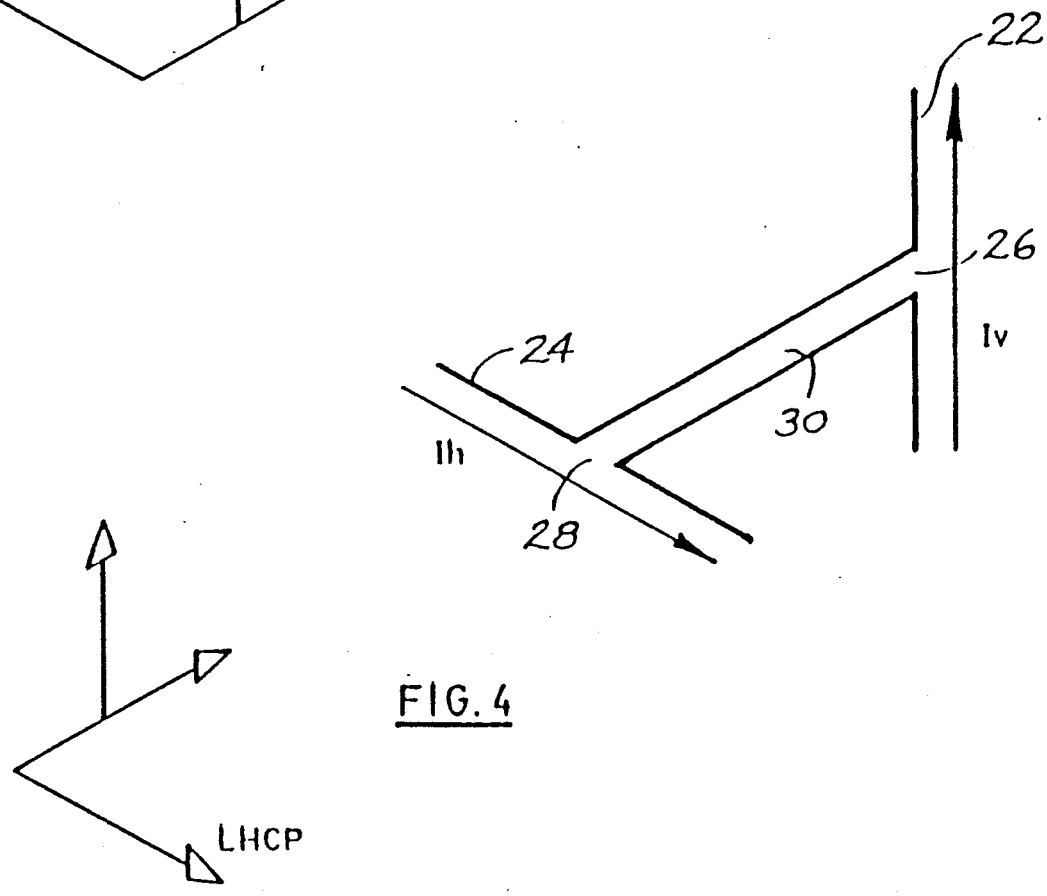

The electrical operation of the antenna unit is best understood by reference to FIGS. 3 and 4. With particular reference to FIG. 3, if the horizontal and vertical components of an incident right hand circularly polarized electromagnetic wave arrive in phase on their respective dipole, the currents $I_v$ and $I_h$ flowing along the dipoles will be in opposite directions and no current will flow in the connecting transmission line. The mid-point of the transmission line will thus appear as an open circuit and this virtual open circuit transforms to a short circuit at the dipole feed points 26 and 28. The incident wave is then totally reflected.

With reference to FIG. 4, if the horizontal and vertical components of an incident left hand circularly polarized electromagnetic wave arrive in phase on their respective dipole, the currents $I_v$ and $I_h$ flowing along the dipoles will be in the same direction and current will flow in the connecting transmission line. The mid-point of the transmission line will thus appear as a short circuit and this virtual short circuit transforms to an open circuit at the dipole feed points 26 and 28. The incident wave is then totally transmitted.

Stated somewhat differently, for a circularly polarized electromagnetic wave emanating from the left, as viewed in FIG. 2, and in which the vertical component is a quarter wavelength ahead of its equi-amplitude horizontal partner, the horizontal component will reach the feed point 28 of horizontal dipole 24 at the same time that the vertical component reaches feed point 26 of vertical dipole 22. Thus, the two waves of equal amplitude and phase enter opposite ends of the transmission line causing an open circuit to appear at its mid-point. This open circuit when transformed back through the transmission line causes a short circuit to appear at feed points 26 and 28 of the dipoles 22 and 24, respectively. Thus, both dipoles appear as half wave reflectors and the incident wave is reflected back to the left.

If, on the other hand, the horizontal component is a quarter wavelength ahead in time of the vertical component, the vertical component reaches feed point 26 at the same time that the horizontal component reaches feed point 28 but is 180 degrees out of phase. This causes a short circuit to appear across the mid-point of the transmission line and, hence, both dipoles appear to be open circuited at their respective feed points and the incident wave is passed with little attenuation.

It will be seen then that a surface formed of such dipole pairs will reflect one type of circular polarization efficiently while passing the opposite type of polarization with little attenuation. Such a surface may form part or all of a main reflector or a subreflector and will result in the same benefits with circular polarization that conventional polarization-twist antennas achieve with linear polarization.

Figure 5:
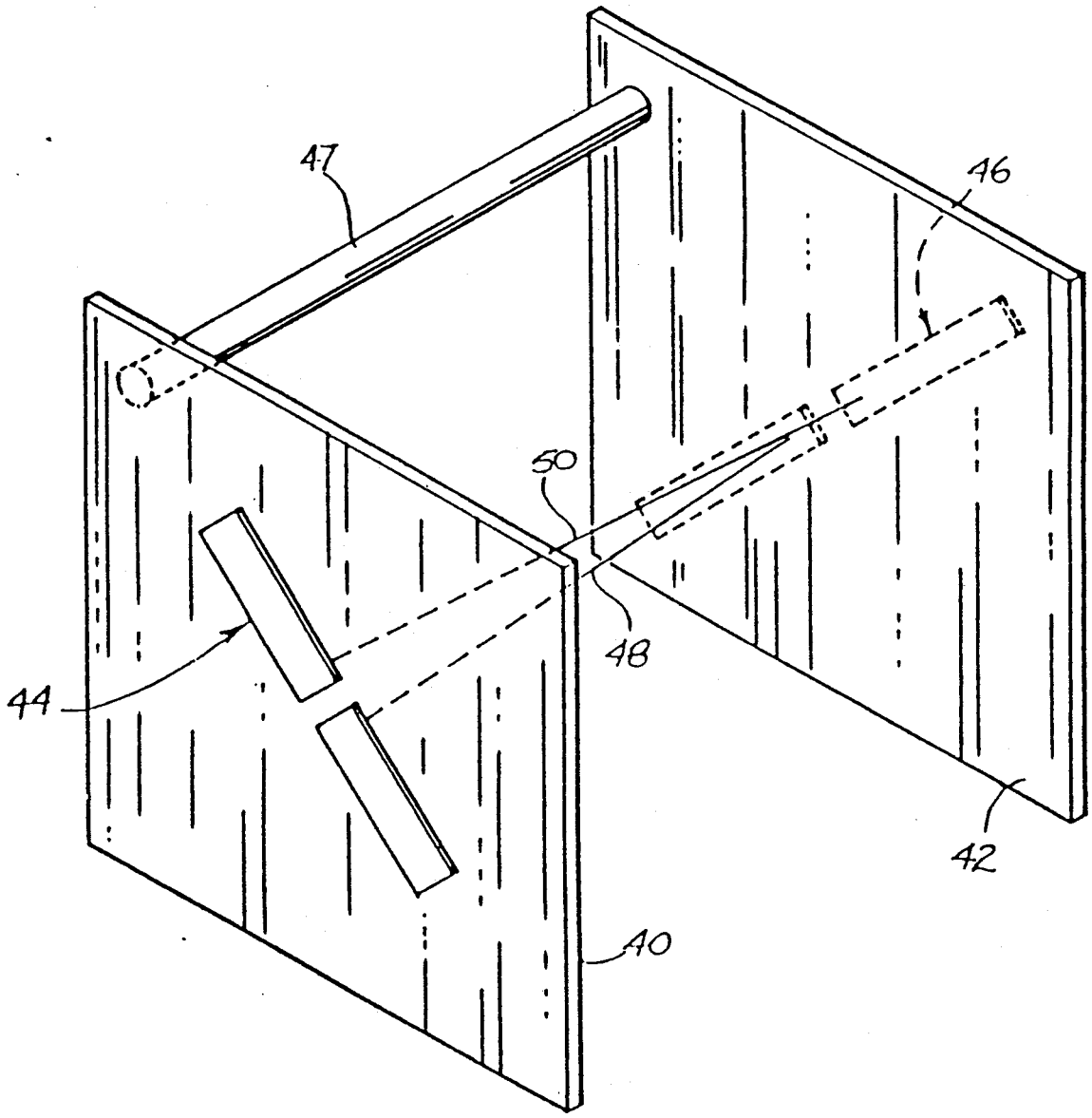
FIG. 5 is a schematic perspective view of a unit cell of a polarization selective antenna surface for electromagnetic waves in the lower range of frequencies of electromagnetic waves.
Figure 6:
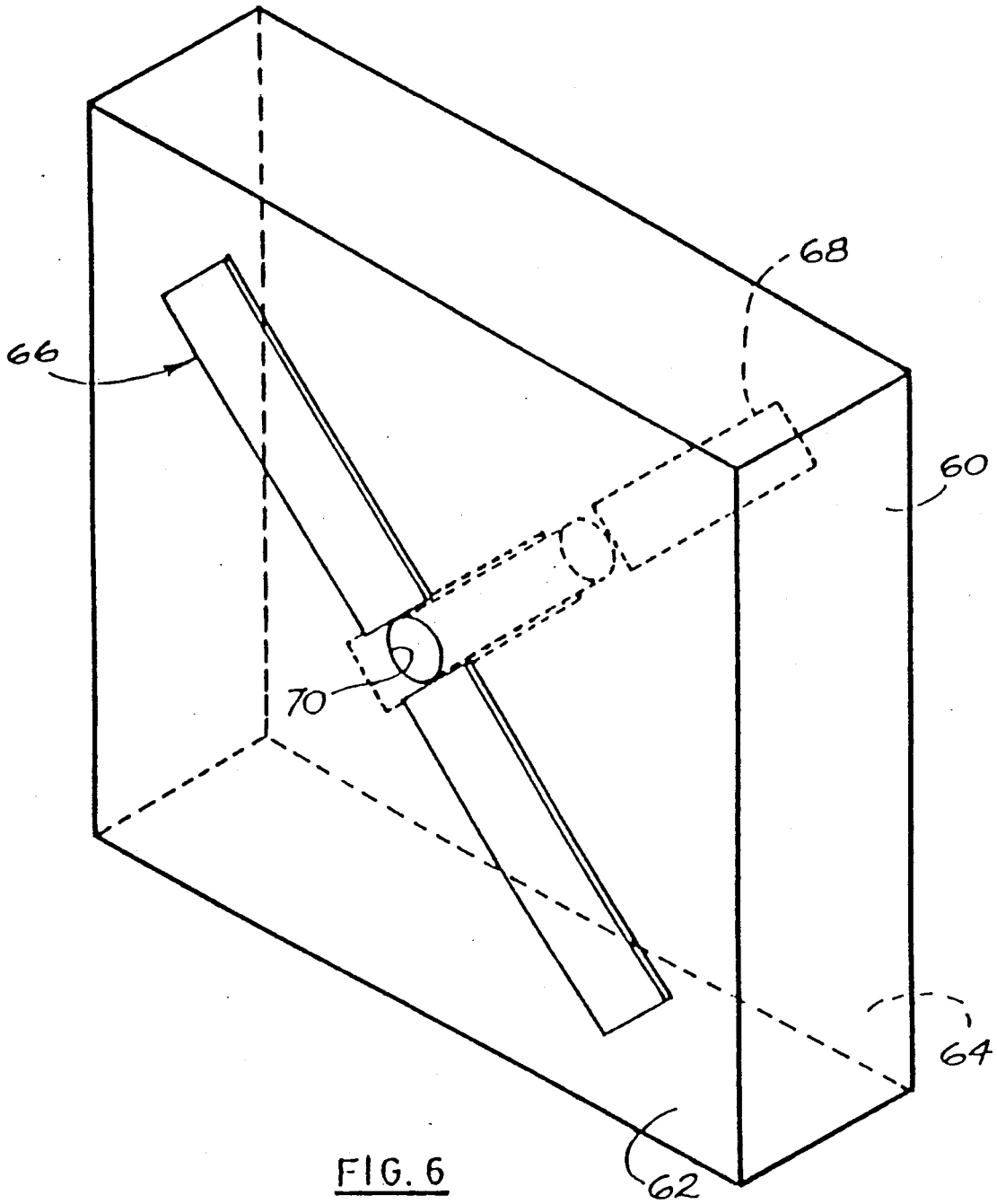
FIG. 6 is a schematic perspective view of a unit cell of a polarization selective antenna for electromagnetic waves in the higher range of frequencies of electromagnetic waves.

FIGS. 5 and 6 illustrate two preferred modes of making circular polarization selective surface. The mode employed depends upon the desired operating frequency although there are no set frequency ranges yet known to the inventors to provide assistance in selecting the modes.

With reference to FIG. 5, there is illustrated a pair of dielectric sheets or panels 40 and 42 on which dipoles 44 and 46 have been formed using photographic printed circuit techniques well known in the art. The two panels are aligned and spaced apart in parallel relation by dielectric rods 47 (only one of which is shown). A suitable foam could also be used to separate the panels. Balanced transmission lines 48 and 50 are soldered or otherwise electrically connected to the dipoles. This arrangement is preferred for lower frequencies.

With reference to FIG. 6, there is illustrated a single dielectric sheet or panel 60 having an optimum electrical thickness of 90°. The sheet is formed with opposed parallel surfaces 62 and 64 on which dipoles 66 and 68 have been formed using photographic printed circuit techniques as in the embodiment of FIG. 5. The interconnections between the dipoles are provided by plated through holes 70. This arrangement is preferred for higher frequencies.

Figure 7:
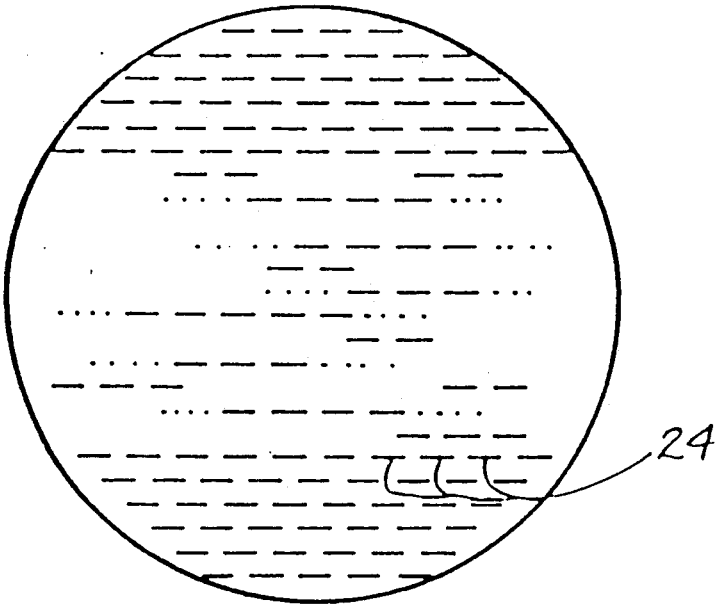
FIG. 7 is a schematic plan view of a dish antenna illustrating a plurality of aligned dipoles.

It will be understood by those skilled in the art that a multiplicity of dipole pairs would be provided on a dish antenna, for example, as shown in FIG. 7 with all of the dipoles on each of the surfaces being aligned with one another. It will also be understood that the panels or sheets would be suitably shaped, i.e. parabolic, spherical, cylindrical and so forth, to a specific application.

The embodiments of the invention in which an exclusive property or privilege is claimed are defined as follows:

1. A surface for electromagnetic waves for use in discriminating between left hand and right hand circular polarization, comprising:

at least one pair of dipoles, each dipole of said pair having a feed point, one of said dipoles of said at least one pair of dipoles being a vertical dipole for receiving a vertical component of circular polarization and the other of said dipoles of said at least one pair of dipoles being a horizontal dipole for receiving a horizontal component of circular polarization; and a transmission line extending between and electrically connecting said feed points of said dipoles of said at least one pair of dipoles; wherein said dipoles of said at least one pair of dipoles are separated optimum by 90 electrical degrees in time and said transmission line has an optimum length of 180 electrical degrees or integral multiples thereof;

whereby, when two components of an incident circularly polarized electromagnetic wave are incident upon respective dipoles in phase, said incident wave is reflected and, when two components of an incident circularly polarized electromagnetic wave are incident upon their respective dipoles 180 electrical degrees out-of-phase, said incident wave is passed substantially unaffected, said surface for electromagnetic waves further including a support for said dipoles of said at least one pair of dipoles, said support comprising a body formed of dielectric material having parallel opposed surfaces spaced apart and a thickness of optimum 90 electrical degrees, said body having a hole extending therethrough and opening into said surfaces and constituting said transmission line.

2. A surface for electromagnetic waves for use in discriminating between left hand and right hand circular polarization components of circularly polarized electromagnetic waves in a predetermined frequency band, said surface comprising:

a body having opposed, substantially parallel surfaces formed of a dielectric material and having an optimum thickness of 90 electrical degrees;

a first plurality of pairs of parallel, resonant dipole antenna elements, each dipole antenna element of a pair having a feeding point, one of said dipole antenna elements of a pair being a vertical dipole antenna element for receiving a vertical component of circular polarization and being disposed on one of said surfaces and the other of said dipole antenna elements of a pair being a horizontal dipole antenna element for receiving a horizontal component of circular polarization and being disposed on the other of said surfaces;

respective electrical transmission line means for each dipole pair having a length of optimum 180 electrical degrees electrically connecting said feed points of each of said dipole antenna elements of each said pair of dipole antenna elements;

whereby, a circularly polarized incident wave is reflected when one component of said wave is incident upon its respective dipole antenna elements in phase with and at the same time that the other component of said wave is incident upon its respective dipole antenna elements and said wave is transmitted when one component of said wave is incident upon its respective dipole antenna elements out of phase with and at the same time that the other component of said wave is incident upon its respective dipole antenna elements.

3. A surface for electromagnetic waves as defined in claim 2, said surface comprising first and second sheets of dielectric material and electrical insulating means for maintaining said sheets in spaced apart and parallel relation.

4. A surface for electromagnetic waves as defined in claim 3, said insulating means comprising a plurality of dielectric spacers extending between said sheets.

5. A surface for electromagnetic waves as defined in claim 3, said insulating means comprising foam material disposed between said sheets.

6. A surface for electromagnetic waves as defined in claim 2, wherein said parallel surfaces are planar, said surface including a plurality of holes extending through said material and opening into said surfaces, each of said holes containing a transmission line.

* * * * *